US005801608A

United States Patent [19]

Mader

[11] Patent Number: 5,801,608

[45] Date of Patent: Sep. 1, 1998

[54] ELECTROMAGNETIC RELAY WITH COMBINED CONTACT/RESET SPRING

[75] Inventor: Leopold Mader, Moedling, Austria

[73] Assignee: EH-Schrack Components-AG, Vienna, Austria

[21] Appl. No.: 804,608

[22] Filed: Feb. 24, 1997

[30] Foreign Application Priority Data

Feb. 23, 1996 [DE] Germany ..... 196 06 883.5

[51] Int. Cl.[6] ..... H01H 67/02; H01H 51/22; H01H 51/08

[52] U.S. Cl. ..... 335/128; 335/78; 335/79; 335/80; 335/81; 335/82; 335/83; 335/84; 335/85; 335/86; 335/132; 335/140

[58] Field of Search ..... 335/78–86, 128, 335/130, 132–140

[56] References Cited

U.S. PATENT DOCUMENTS

| | | | |
|---|---|---|---|
| 4,554,520 | 11/1985 | Minks | 335/106 |
| 4,600,909 | 7/1986 | Willson | 335/133 |
| 4,720,694 | 1/1988 | Schroeder | 335/128 |
| 4,743,877 | 5/1988 | Oberndorfer et al. | 335/128 |
| 4,910,484 | 3/1990 | Shikano et al. | 335/61 |

FOREIGN PATENT DOCUMENTS

| | | |
|---|---|---|
| 0186160 | 7/1986 | European Pat. Off. . |
| 0 375 398 A2 | 12/1989 | European Pat. Off. . |
| 26 27 168 | 6/1976 | Germany . |
| 36 44 172 C2 | 12/1986 | Germany . |
| 39 08 442 C2 | 3/1989 | Germany . |

*Primary Examiner*—Renee S. Luebke
*Assistant Examiner*—Tuyen T. Nguyen
*Attorney, Agent, or Firm*—Hill & Simpson

[57] ABSTRACT

The relay has a magnet system with an armature that operates on a switching spring via an actuating element. This switching spring has a frame-shaped contact spring as well as a fork-shaped reset spring, intermeshed in one plane and mutually decoupled, whereby the reset spring guides the actuating element via at least two linkage points lying in a line parallel to the pivot axis. The relay of the present invention provides a compact construction with few individual parts and a very low-friction operation.

18 Claims, 5 Drawing Sheets

ELECTROMAGNETIC RELAY WITH COMBINED CONTACT/RESET SPRING

FIELD OF THE INVENTION

The present invention is related electromagnetic relays and, more specifically, to electromagnetic relays with a combined contact/reset spring.

BACKGROUND OF THE INVENTION

EP 0 375 398 A2 presents an unpoled relay with a flat magnet system and a make contact arrangement arranged underneath the magnet system. The actuation of the contact spring is provided via a lever-type actuating element, which is itself mounted pivotably in the housing. The lever-type actuating element has points of contact both with the armature and with the contact spring, which respectively undergo relative motions, with corresponding friction, due to the separate mounting of the actuating element. In addition, there is the bearing friction of the actuating element itself. The armature resetting is provided by means of the contact spring. In this arrangement, a changeover contact can be realized only with difficulty, since in the non-operating state armature oscillations would have an immediate effect on the break contact. Moreover, an additional armature spring is required to hold the armature in its bearing.

A relay of the type named above, with a general construction, is also already known from DE 26 27 168 B2, in which a separate reset limb branches off from the contact spring, whereby different pre-stress forces are produced through corresponding opposed bendings. However, no precise guiding of the actuating element is possible by means of the switching spring shown in DE 26 27 168 B2. Accordingly, an additional guiding with friction for the actuating element is required for the practical construction of this system.

The aim of the present invention is to improve the relay named above in such a way that it can be manufactured with as few parts as possible, that is as simple as possible to manufacture, with a compact relay construction and low-friction actuation of the contact spring. A switching spring with a reset function is therefore desired that enables a precise, low-friction guiding of the actuating element, whereby a low response performance is also achieved. Given a corresponding construction, it should also be possible with this switching spring to forego a separate armature spring.

SUMMARY OF THE INVENTION

According to the invention, this aim is achieved in a relay of the type named above in that the reset spring lies at least approximately in one plane with the contact spring, and further that the actuating element, which is movable perpendicular to the longitudinal extension of the switching spring, is guided by the reset spring via at least two linkage points along a line parallel to the axis of rotation of the switching spring.

The electromagnetic relay of the present invention comprises a magnet system, comprising a coil, a stationary core-yoke arrangement, and a pivotably mounted armature. The relay of the present invention further comprises a contact arrangement having an elongated contact spring with a movable contact and at least one contact bearer with a fixed contact. An actuating element is coupled to a movable end segment of the armature as well as to the contact spring, whereby the contact spring is part of a switching spring clamped on one side, which in addition forms a reset spring coupled with the actuating element.

Thus, in the invention a switching spring is used that forms both the contact spring and the reset spring, essentially in a common plane and in one piece, and can be manufactured by means of a simple cutting method. Of course, it is not thereby excluded that individual spring tabs, whether for resetting or contact actuation, are bent slightly out of the common spring plane for purposes of adjustment. However, in principle no sharp bendings or angles into different planes, which would require a complicated manufacturing process, are required for this switching spring. Moreover, the switching spring forms at least two actuation points aligned with one another, by means of which the actuating element is grasped and guided in a low-friction manner, whereby the linkage points, which are spaced at a distance from one another, form at the same time a safeguard against lateral tipping and against friction on other parts of the construction.

Although a single-limb reset spring, given corresponding breadth in the area of the actuating element, can also enable the inventive guiding, the reset spring preferably has two reset limbs separate from one another, which can run either on both sides of the actual contact spring, on the outer side thereof, or, given a frame-shaped construction of the contact spring, can run inside the side limbs thereof. The actuating element is correspondingly constructed in each case.

The switching spring thereby presents a symmetrical construction, also with respect to a symmetrical distribution of forces with as little friction as possible. Given the mentioned frame shape of the contact spring, the two reset limbs are preferably formed through a fork-shaped construction of the reset spring, whereby these two reset limbs respectively extend alongside the side limbs or arms of the contact spring inside the frame shape thereof. The coupling to the actuating element ensues preferably by means of guide noses or tabs, which are respectively angled off on the two reset limbs inwardly towards one another and transversely to their longitudinal extension, and engage in guide grooves or slots of the actuating element that are aligned with one another. In the preferred embodiment, the actuating element is matched with its outer contour to the fork shape of the reset spring, and is guided between the reset limbs thereof.

The contact spring is usefully switched, via at least one actuating tab branched off from it that lies outside the current path, respectively by means of an associated switching cam of the actuating element, whereby the switching cam is respectively displaced in relation to the linkage points of the reset spring in the direction of actuation. By means of this last-named displacement, there results, even with a completely flat switching spring, a different pretension for contact actuation and for the resetting of the armature. The actuating tab lying outside the current path has the advantage that at high switching capacities it is less strongly heated than the actual current-conducting regions of the contact springs. The danger of a heat deformation of the actuating element is thereby also avoided. In a preferred embodiment of the contact spring with the above-mentioned frame shape, two actuating tabs are usefully also branched off from the contact segment of the contact spring in the direction towards the interior of the frame shape thereof, in such a way that their ends respectively stand opposite one end of a reset limb.

In a further embodiment of the relay, the magnet system comprises an essentially flat armature that extends approximately parallel to the switching spring, is mounted at one end to a core segment via a bearing end segment, and is pre-stressed away from the magnet system with the other, movable end via the actuating element by means of the reset spring, whereby the armature lies pivotably with its center segment on a lever line or fulcrum line parallel to the bearing axis, so that its bearing end segment is pressed into the bearing due to the lever effect. In such an embodiment, the switching spring can thus additionally press the armature into its bearing via the actuating element, so that it lies on the core even when the magnet system is not excited, so that an additional armature spring is not required. This functioning of the armature bearing via the switching spring can also advantageously be used in the inventive relay for a changeover contact, because the holding function ensues by means of the reset spring, which is separate in terms of function, and there is no danger of a detrimental effect on the break contact by the armature mass. The lever or fulcrum line, as the pivot point for the armature, is preferably produced by a roll-off edge formed on the basic element. However, the converse case, in which a bend or roll-off web fashioned on the armature could roll off on a flat surface of the basic element, would also be possible as well as other embodiments such as a laterally extending rib.

BRIEF DESCRIPTION OF THE DRAWINGS

For a more complete understanding of the present invention, reference should now be made to the embodiments illustrated in greater detail in the accompanying drawings described below by way of examples of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
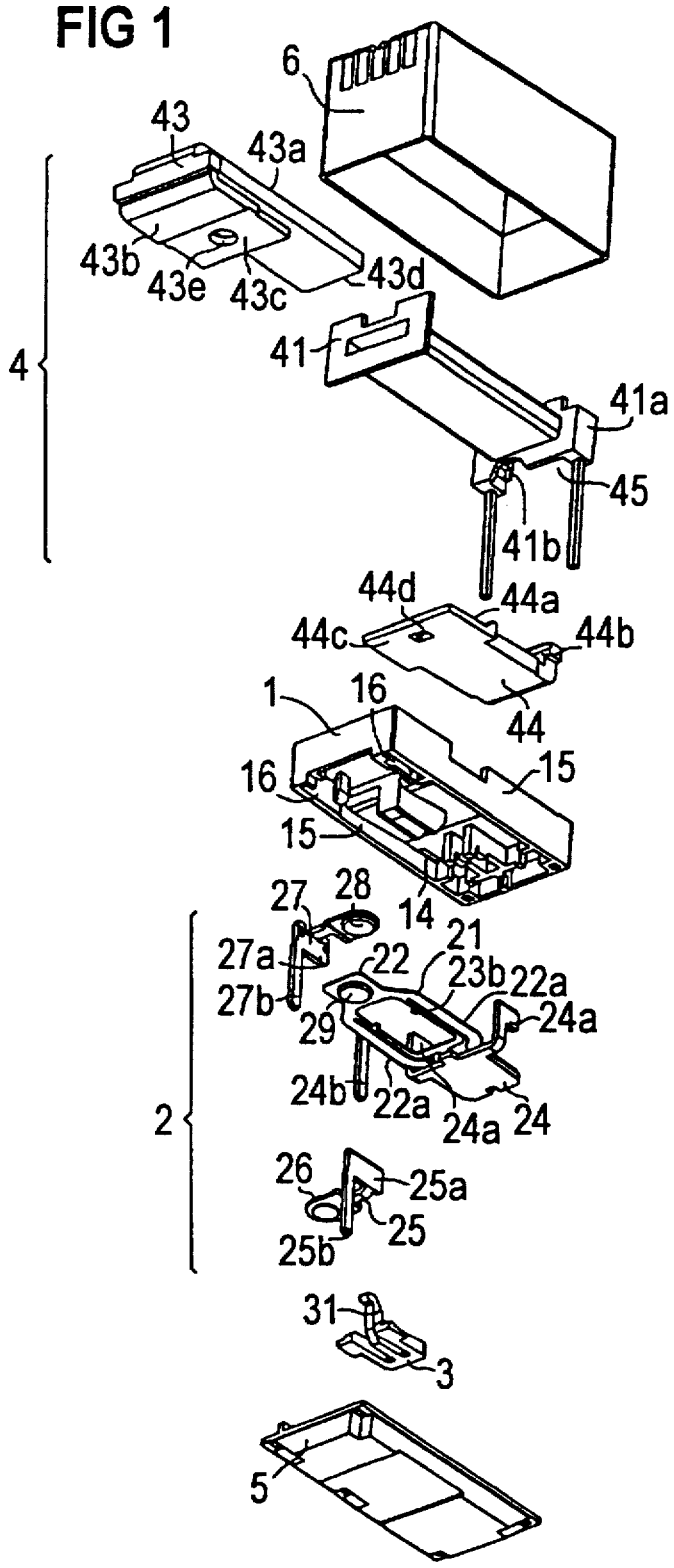
FIG. 1 is an exploded perspective view of a relay constructed in accordance with the present invention.

As illustrated in FIG. 1, the relay shown in FIGS. 1 to 7 consists of a base element 1 bearing on its underside a contact arrangement 2 with an actuating element or actuator 3, as well as a magnet system 4 arranged above the basic element. The relay system is arranged in a housing formed by a base plate 5 and a cap 6.

The base element 1 is constructed in the shape of a box from an insulating material, and forms a partition 11 (see FIG. 2) between the magnet system 4 and the contact arrangement 2, comprising only one opening 12 for the actuating element or actuator 3. A switching chamber 13 is formed underneath the partition 11, which chamber is surrounded by side walls 14 of the base element, and which goes over on one side into a contact chamber 13*a* with greater height by means of a stepped construction of the partition 11.

In the switching chamber 13, over the larger part of the length thereof, a switching spring 21 extends approximately parallel to the base side of the relay, which is determined by the base plate 5. The switching spring 21 is cut as a flat plate spring, and forms a frame-shaped contact spring 22 with current-conducting side arms 22*a* that unite at the free end to form a contact end 22*b*. A movable contact 29 is fastened to the contact end 22*b*. Moreover, on the contact end 22*b*, two actuating tabs 22*c* are cut free on both sides inside the frame shape, in such a way that they point in the direction of the clamping point.

Figure 3:
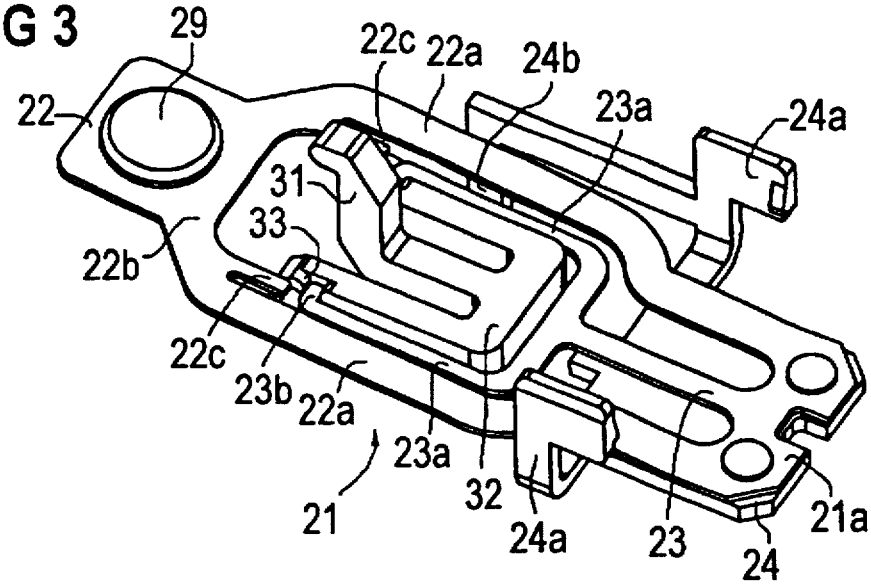
FIG. 3 is a top perspective view of a switching spring, spring bearer and actuating element first shown in FIG. 1.

In addition, the switching spring 21 as illustrated in FIG. 3 forms a fork-shaped reset spring 23 in one piece with the contact spring 22, which reset spring is essentially separated from the fastening end 21*a* of the switching spring, going out from the contact spring 22, and extends with two reset arms 23*a* essentially parallel to the inside the frame shape of the contact spring 22, parallel alongside the side arms 22*a* thereof (see also FIG. 3). The reset spring 23 forms, with its reset arms 23*a*, a U-shape, matched to the outer contour of the actuator 3, still to be specified.

The switching spring 21 is fastened at its fastening end 21*a* to a spring bearer 24, which for its part is anchored via fastening tabs 24*a* in plug wells 14 on opposed side walls 15 of the base element 1. The fastening tabs 24*a* have hook-shaped contours for better anchoring. Moreover, a terminal lug 24*b* is integrally formed on the spring bearer 24, which lug is led outward by means of a corresponding opening in the base plate 5.

Figure 2:
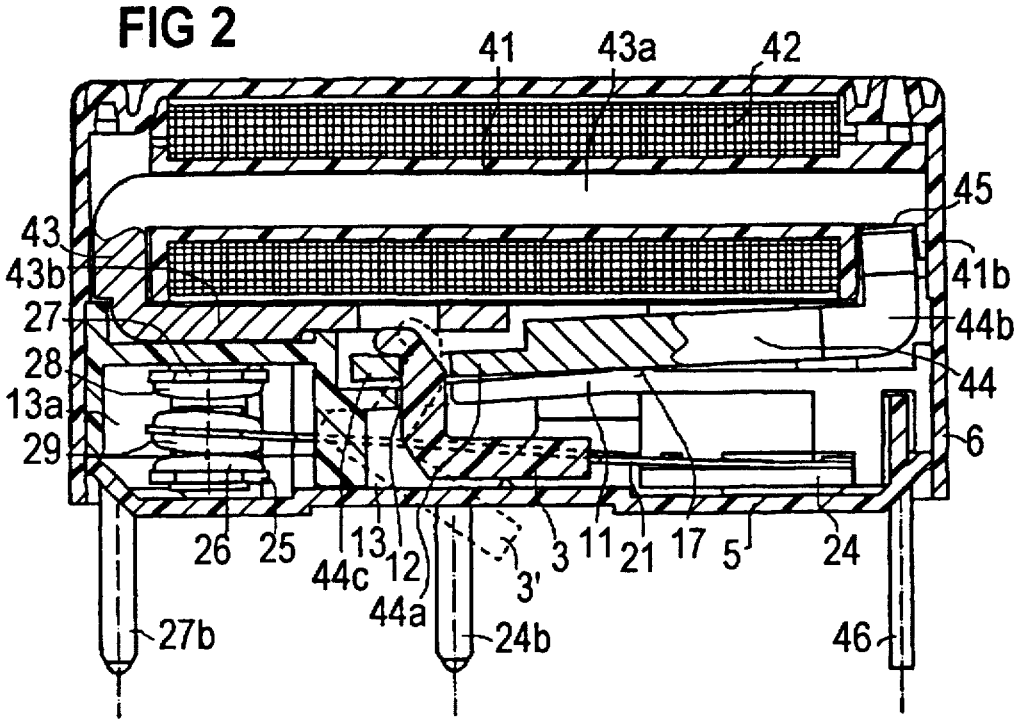
FIG. 2 is a longitudinal sectional view of the relay first illustrated in FIG. 1 and assembled in accordance with the present invention.

Referring to FIGS. 1 and 2, the contact arrangement further comprises a break contact bearer 25 with a break contact 26, as well as a make contact bearer 27 with a make contact 28. Both contact bearers are anchored in corresponding plug wells 16 of the base element 1 via fastening segments 25*a* or, respectively, 27*a*. In addition, they respectively have terminal lugs 25*b* or, respectively, 27*b*, led outward through the base plate 5. The contact bearers 25 and 27 are so constructed and so arranged in the contact chamber 13*a* that the movable contact 29 alternatively works together with the break contact 26 and the make contact 28.

The magnet system 4, arranged above the base element 1, has a coil body 41 with a winding 42 whose axis lies parallel to the base side of the relay. A core yoke 43 forms, in one piece, a core limb 43*a*, which extends axially through the entire coil, and a yoke limb 43*b*, which extends parallel to the core limb underneath the coil, close to the winding, up to about half the coil length. An armature 44 extends with its main part flat in extension of the yoke limb 43*b*, whereby a pole end segment 44*a*, set back in cross-section, overlaps a pole segment 43*c* of the yoke limb, likewise reduced in cross-section.

A bearing end segment 44*b* of the armature is angled towards the free core end 43*d*, and is mounted in a pocket or recess 45 of a coil body flange 41*a* in such a way that it rolls off on the free core end 43*d*. The coil body flange 41*a* surrounds this free core end 43*d* on three sides, and secures the bearing end segment 44*b* of the armature with holding ribs 41*b*, even against movement in the axial direction of the coil. Moreover, this bearing end segment 44*b* of the armature is pressed into the bearing at the core end 43*d* by the resetting force of the reset spring 23. This resetting force operates on the movable armature end 44*c*, and draws it downwards away from the coil. By this means, when the magnet system is not excited, the armature is pivoted as a lever about a roll-off edge 17 on the upper side of the partition 11 (counterclockwise in the view shown in FIG. 2) in such a way that the bearing end segment 44*b* of the armature is pre-stressed into the bearing. In this way, a separate bearing spring can be dispensed with.

By means of the arrangement of the yoke limb 43*b* immediately below the winding 42 (with an insulating intermediate layer if necessary), upon excitation of the magnet system the armature 44 is drawn in the direction towards the coil, so that the switching spring 21 is also drawn in this direction via the actuating element 3. In this way, there results underneath the yoke limb 43*b* the already-mentioned large contact chamber 13*a*, while for the switching spring 21 the lower switching chamber 13 underneath the moved armature is sufficient. The actuating element 3, which transmits the switching motion of the armature, has a hook part or element 31 that passes through the opening 12 of the partition 11 essentially parallel to the plane of the base 5, and is hung on an opening 44*d* of the armature 44 with its hook-shaped end. A recess 43*e* is also provided in the pole segment 43*c* of the pole limb 43*b*, over the free end of this hook part 31, which recess enables the armature to be laid completely on the yoke limb in this area.

Moreover, the actuating element 3 has a flat foot portion 32 that lies essentially in the plane of the switching spring 21, and, in this example, has an M-shaped construction. The middle limb of the M is thereby connected with the hook part 31. A guide groove 33 is respectively formed in both outer limbs of the foot part 32, in which a guide nose or tab 23*b* of the adjacent reset limb 23*a* respectively engages. At the free ends of this outer limb, an actuating cam 34 is respectively laterally integrally formed, which cam lies underneath the adjacent actuating tab 22*d* of the contact spring, and brings the contact spring into the make (or closed) position upon an upward-directed motion of the actuating element 3. By matching the heights of the upright point on the actuating cam 34 on the one hand and of the guide grooves 33 on the other hand, the reset position of the armature can be set in relation to the make position of the break contact, even if the reset spring and the contact spring are originally located in one plane. Otherwise, a corresponding position can however also be set through a slight bending of the reset limb 23*a* on the one hand or, respectively, of the actuating tabs 22*c* on the other hand.

In order to increase the insulation between the magnet system and the contact arrangement, an insulating collar 18 is integrally formed on the partition 11 toward the underside, which engages in labyrinth fashion between the limbs of the M-shaped foot part 32 of the actuating element 3, and in this way creates long creep paths.

Figure 4:
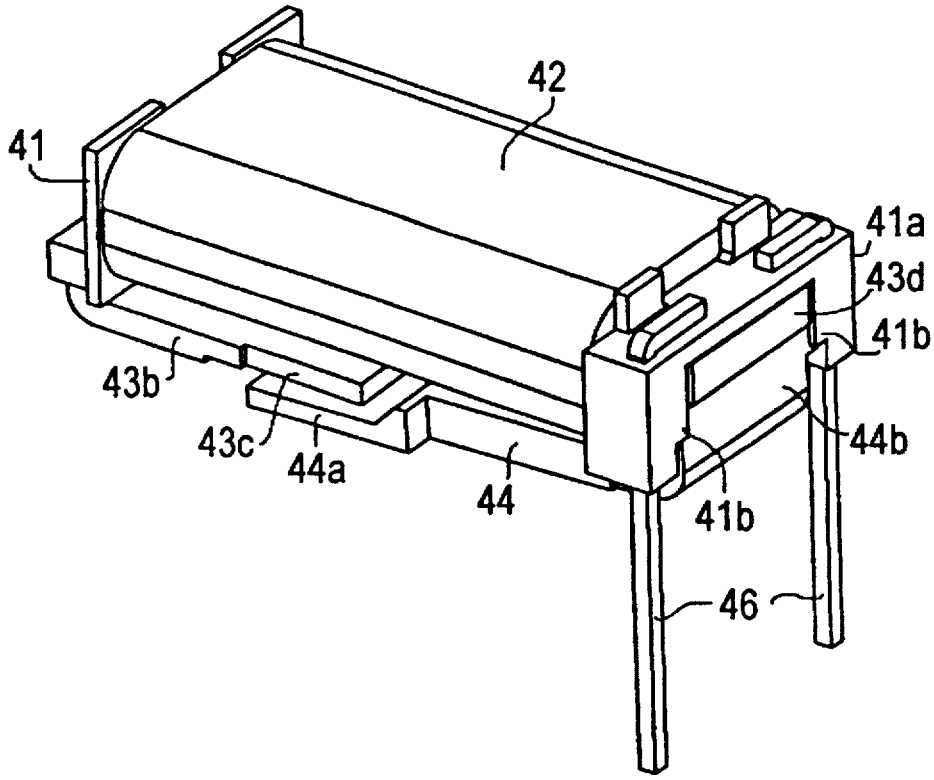
FIG. 4 is a top perspective view of the magnet system first shown in FIG. 1.
Figure 5:
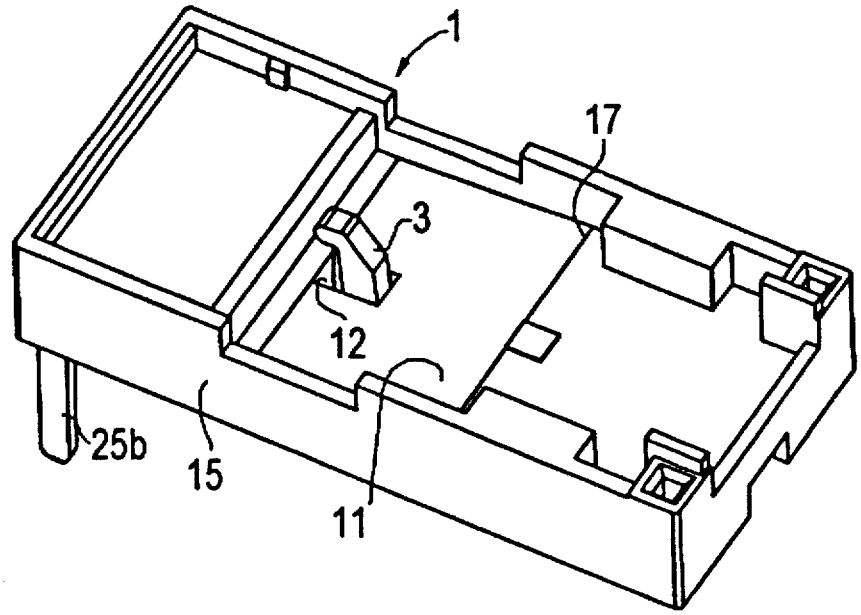
FIG. 5 is a top perspective view of the base element first shown in FIG. 1.
Figure 6:
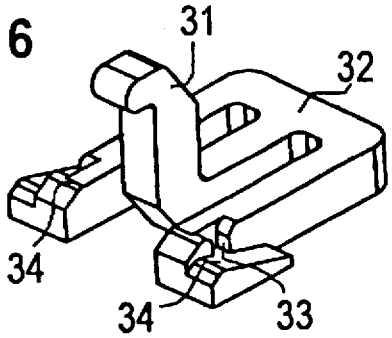
FIG. 6 is a top perspective view of the actuating element first shown in FIG. 1.
Figure 7:
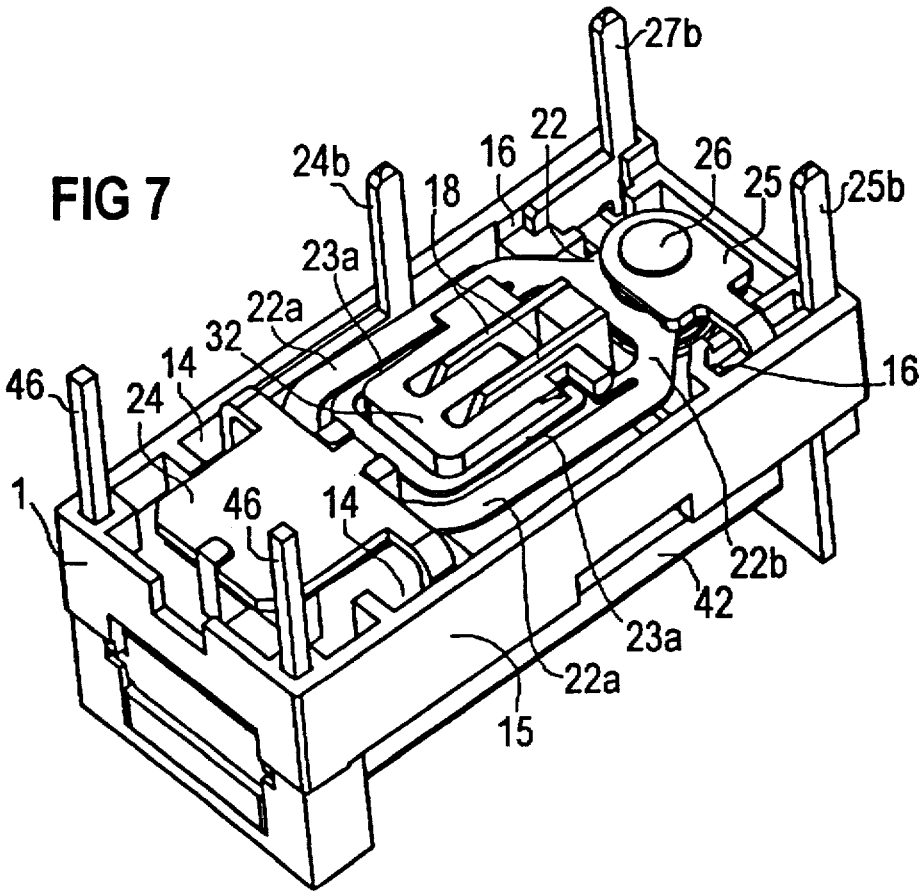
FIG. 7 is a bottom perspective view of the base element as assembled to the contact arrangement first shown in FIG. 1.

The assembly of the relay provides on the one hand the magnet system according to FIG. 4 is pre-assembled, and on the other hand the contact arrangement 3 is anchored in the base element from the underside thereof. The magnet system according to FIG. 4 is assembled with the basic element according to FIG. 5, whereby coil terminal pins 46 are plugged into corresponding openings of the base element 1. The actuating element 3 is then plugged through the frame-shaped switching spring from the underside in, and is hooked into the armature 44. For this purpose, the actuating element 3 is first led upward in an angled position, as shown in broken lines in FIG. 2 with the reference character 3', is plugged into the opening 12 with the hook part 31 and is then pivoted into the final position. By means of this type of assembly of the actuating element without snap connections, all plastic wear, which could endanger the contacts, is also avoided. By setting on the base plate 5 and the cap 6, the housing is then formed, which can also be sealed in a known fashion.

The functioning of the relay results already from the specified allocation of the parts. Given an excitation of the magnet system, the armature 44 is drawn with its pole end 44*a* to the pole segment 43*c* of the yoke limb 43*b*, whereby the contact spring 22 is drawn upwards via the actuating element 3 and the movable contact 29 is brought into contact with the make contact 28. When the excitation is switched off, the reset spring 23, with its reset limbs 23*a*, draws the actuating element 3 and the pole end 44*c* of the armature 44 downward, whereby the armature 44 tips in the manner of a lever on the roll-off edge or fulcrum 17, and its bearing end segment 44*b* is biased towards the free end 43*d* of the core limb 43*a*, even without excitation of the coil.

Figure 8:
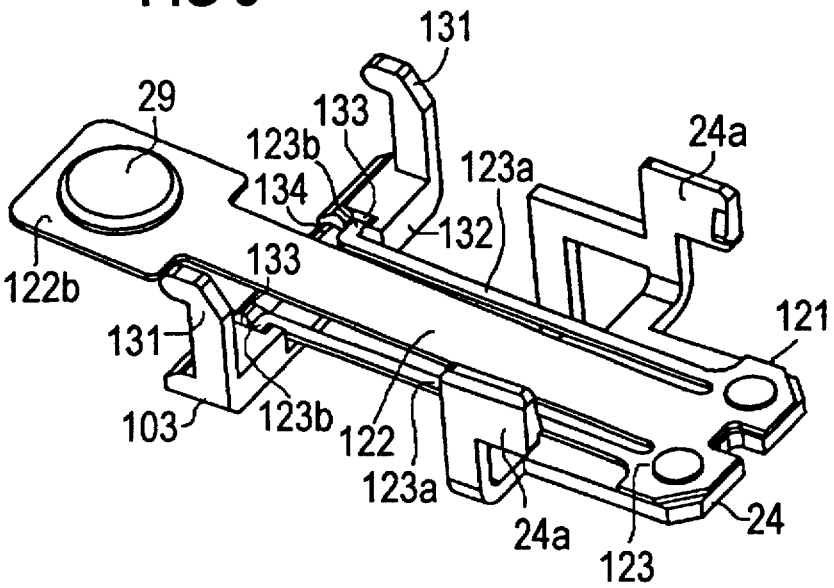
FIG. 8 is a top perspective view of a second embodiment of a switching spring made in accordance with the present invention.
Figure 9:
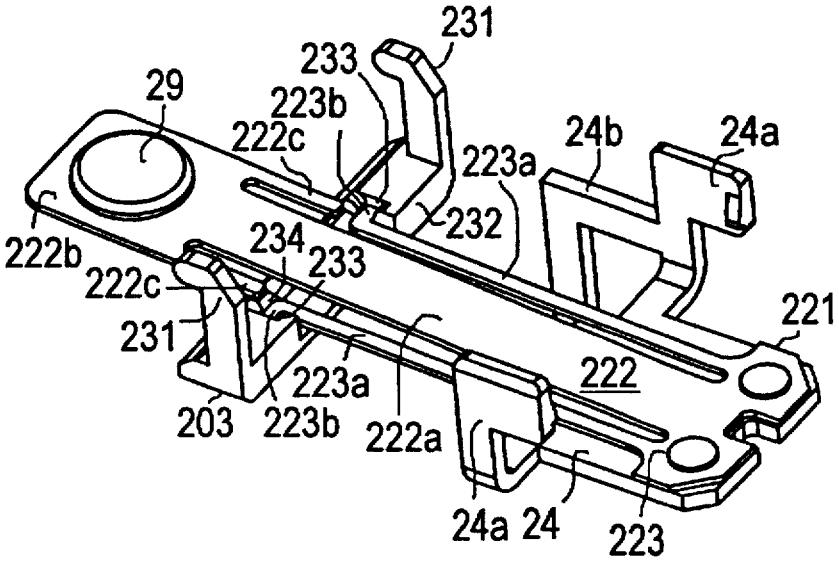
FIG. 9 is a top perspective view of a third embodiment of a switching spring made in accordance with the present invention.

FIGS. 8 and 9 show two further possible embodiments of the switching spring, and correspondingly of the actuating element. The switching spring 121 according to FIG. 8 accordingly possesses a contact spring 122, which, in a modification relative to the contact spring 22 of FIG. 3, now has only a single limb arranged in the center, an end of which has a contact end 122*b* which bears the movable contact 29. In this case, the reset spring 123 is formed by two reset limbs 123*a*, which extend next to the outer sides of the contact spring 122 on both sides, and which respectively comprise actuating noses 123*b*, angled off outwardly, at their free ends. Corresponding to the modified shape of the switching spring 123, a modified actuating element 103 is also provided. This has a U-shaped construction, with two hook elements 131 as outer limbs, and a foot portion 132 that connects the two hook parts, which foot part extends underneath the switching spring, transverse to it, and comprises both a centric cam segment 134 for the actuation of the contact spring 122 and two laterally arranged guide grooves 133 for the accepting of the mentioned guide noses or tabs 123*b*. The two hook elements 131 extend upward up to the armature, whereby the armature is of course correspondingly constructed on both sides in order to permit a hanging of the hook elements 131, and whereby also the base element must now comprise two externally situated openings in its partition, in place of the previously specified centric opening 12. The spring bearer or clamped end 24 is constructed as in the previous exemplary embodiment.

FIG. 9 shows a further modification in relation to FIG. 8. Like the switching spring 121, the switching spring 221 has a centric contact spring 222 with a contact segment 222*b*, as well as a reset spring 223 formed by externally situated reset limbs 223*a*, whereby the reset limbs respectively comprise a guide nose 223*b* at their end. The actuating element 203 is constructed in a U-shape, similar to the actuating element 103. It has two hook parts 231, as well as a foot part 232 that runs transversely, in which guide grooves 233 for the reception of the guide noses 223*b* are integrally formed. However, the actuation of the contact spring 222 now does not ensue immediately at the center limb 222*a*, but rather via laterally integrally formed actuating tabs 222*c*, which are approximately aligned with the reset limbs 223*a*, and respectively lie on an actuating cam 234 of the actuating element 203. For the adaptation of the armature and of the basic element to the altered actuating element, the same holds as for FIG. 8. In other respects, the functioning results from the specification of the first exemplary embodiment.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An electromagnetic relay comprising:

a magnet system comprising a coil, a stationary yoke and a pivotally mounted armature, the armature comprising a pole end, a contact arrangement comprising an elongated switching spring having a movable contact, the contact arrangement further comprising at least one contact bearer having a fixed contact, an actuator having at least one upper end coupled to the pole end of the armature and a lower foot portion, the switching spring comprising a contact spring comprising a clamped end and a contact end that accommodates the moving contact, the switching spring further comprising a reset spring, the reset spring being connected to the contact spring, the reset spring being coupled to the lower foot portion of the actuator, the reset spring being disposed in a common plane with the contact spring and the foot portion of the actuator.

2. The relay of claim 1 wherein the foot portion of the actuator comprises two opposing sides, the reset spring being coupled to the actuator at both opposing sides of the foot portion of the actuator.

3. The relay of claim 1 wherein the contact spring comprises two spaced-apart side arms connecting the clamped end to the contact end with the reset spring being disposed between the two side arms of the contact spring.

4. The relay of claim 3 wherein the reset spring is characterized having a base portion and two spaced-apart reset arms, the base portion of the reset spring being connected to the clamped end of the contact spring, each reset arm being disposed inside and generally parallel to a side arm of the contact spring.

5. The relay of claim 4 wherein the foot portion of the actuator is disposed between the two reset arms.

6. The relay of claim 4 wherein the contact end of the contact spring further comprises two actuating tabs in alignment with the reset arms of the reset spring and that extend rearward toward the reset arms and that terminate short of the reset arms.

7. The relay of claim 1 wherein the contact spring comprises an elongated arm with opposing side edges, the reset spring comprising two spaced-apart reset arms disposed along opposing edges of the contact spring.

8. The relay of claim 1 wherein upward movement of the pole end of the armature results in upward movement of the actuator and the contact spring.

9. The relay of claim 1 the contact spring further comprises at least one actuating tab which engages the actuator.

10. The relay of claim 1 the contact spring further comprises at least one actuating tab, the actuator further comprising at least one switching cam, the actuating tab of the contact spring being disposed above the switching cam of the actuator and engaging the switching cam of the actuator upon upward movement of the actuator.

11. The relay of claim 1 wherein the yoke comprises a core limb that extends through the coil and terminates at a free end disposed outside of the core, the armature extends approximately parallel to the switching spring, the armature comprising a bearing end disposed opposite to the pole end, the bearing end of the armature being mounted adjacent to the free end of the core limb, the reset spring exerting a downward bias on the actuator and the pole end of the armature.

12. The relay of claim 10 further comprising a base element disposed below the armature and providing a laterally extending fulcrum line about which the pole end of the armature pivots downward and about which the bearing end of the armature pivots upward toward the free end of the core limb under the bias imposed by the reset spring.

13. The relay of claim 11 wherein the fulcrum line comprises a roll-off edge disposed on an upper side of the base element.

14. The relay of claim 12 wherein the fulcrum line comprises a roll-off edge disposed on an underside of the armature.

15. The of claim 12 wherein the base element further comprises an insulating partition between the magnet system and the contact arrangement, the base element having only one opening through which a portion of the actuator extends linking the armature and the switching spring.

16. The relay claim 1 wherein the actuator comprises a hook element that is coupled to the pole end of the armature and a foot portion that engages on the switching spring.

17. An electromagnetic relay comprising:

a U-shaped core yoke having a core limb and a yoke limb, the core limb extending through an elongated coil with a free end of the core limb being disposed outside of the coil, the yoke limb being disposed below the coil and extending along a portion of the coil, the yoke limb having an end portion forming a pole segment, the relay further comprising an armature, the armature comprising an upwardly protruding bearer end disposed adjacent to the free end of the core limb, the armature further comprising an opposing pole end, the opposing pole end being disposed underneath the pole segment of the second yoke limb with a working air gap disposed therebetween, the pole end further comprising a hole for accommodating an end of an actuator, the actuator comprising a hook element and a foot portion, the hook element of the actuator being accommodated in the hole disposed in the pole end of the actuator, the foot portion of the actuator being coupled to a switching spring, the switching spring comprising a contact spring clamped at one end and accommodating the moving contact at the other end, the switching spring further comprising a reset spring, the reset spring being connected to the contact spring, the reset spring being coupled to the actuator at opposing sides of the actuator, the reset spring imposing a downward bias on the actuator resulting in a downward bias on the pole end of the armature, the reset spring being disposed in a common plane with the contact spring and the foot portion of the actuator.

18. An electromagnetic relay comprising:

a magnet system comprising a coil, a stationary yoke and a pivotally mounted armature, the armature comprising a pole end, a contact arrangement comprising an elongated switching spring having a movable contact, the contact arrangement further comprising at least one contact bearer having a fixed contact, an actuator having an upper hook element coupled to the pole end of the armature and a lower foot portion coupled to the switching spring, the lower foot portion including two opposing sides the switching spring comprising a contact spring comprising a clamped end and a contact end with two opposing sides disposed therebetween, the switching spring further comprising a reset spring, the reset spring being coupled to the actuator, the reset spring further comprising two spaced-apart reset arms and a base portion, the base portion of the reset spring being connected to the clamp end of the contact spring, each reset arm being disposed generally parallel to a side of the contact spring, each reset arm comprising a longitudinal axis and a guide tab extending transversely from the longitudinal axis of its respective reset arm, the guide tabs engaging guide grooves disposed in the actuator, the reset spring being disposed in a common plane with the contact spring and the foot portion of the actuator.

* * * * *